US007578506B2

(12) United States Patent
Lambert

(10) Patent No.: US 7,578,506 B2
(45) Date of Patent: Aug. 25, 2009

(54) THREE CARD BLACKJACK

(76) Inventor: Larry Lambert, 3111 Bel Air Dr., No. 203, Las Vegas, NV (US) 89109

( * ) Notice: Subject to any disclaimer, the term of this patent is extended or adjusted under 35 U.S.C. 154(b) by 279 days.

(21) Appl. No.: 11/382,646

(22) Filed: May 10, 2006

(65) Prior Publication Data

US 2007/0262524 A1 Nov. 15, 2007

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS 5,685,774 A * 11/1997 Webb ..... 463/13
5,911,419 A * 6/1999 Delaney et al. ..... 273/292
5,928,081 A * 7/1999 Bochichio et al. ..... 463/13
6,056,641 A * 5/2000 Webb ..... 463/13
6,698,759 B2 * 3/2004 Webb et al. ..... 273/292
6,938,900 B2 * 9/2005 Snow ..... 273/292
7,118,111 B1 * 10/2006 Altomare ..... 273/292
7,175,522 B2 * 2/2007 Hartl ..... 463/11
7,249,765 B2 * 7/2007 Durbin ..... 273/274
7,267,343 B2 * 9/2007 Schreiner ..... 273/292
7,309,066 B2 * 12/2007 Donaldson ..... 273/292
7,331,579 B2 * 2/2008 Snow ..... 273/292
2004/0036217 A1 * 2/2004 Schlumbrecht ..... 273/292

OTHER PUBLICATIONS

International Search Report and Written Opinion, PCT/US2007/067842 (counterpart application to 11/38,646).

* cited by examiner

*Primary Examiner*—Gene Kim
*Assistant Examiner*—Dolores Collins
(74) *Attorney, Agent, or Firm*—Muskin & Cusick LLC

(57) ABSTRACT

A blackjack variation that can be played in a casino. A player is dealt three cards and can take the best two or three card hand out of the three cards. A dealer is dealt three cards and can take the best two or three card hand out of the three cards. If the player's hand beats the dealer's hand, then the player wins, otherwise the player loses. If the player has blackjack, then the player automatically wins.

4 Claims, 3 Drawing Sheets

THREE CARD BLACKJACK

BACKGROUND OF THE INVENTION

1. Field of the Invention

The present inventive concept relates to a casino table game, and more particularly, to a variation of a casino table game.

2. Description of the Related Art

Casino games are currently a billion dollar industry. Blackjack is currently a popular table game, although its popularity has been recently decreasing.

What is needed is a new game which can provide players with a more exciting game than a standard blackjack game.

SUMMARY OF THE INVENTION

It is an aspect of the present invention to provide exciting variations of blackjack that can be played in casinos.

The above aspects can be obtained by a method that includes (a) receiving an ante wager from a player; (b) dealing three player cards to the player; (c) dealing three dealer cards to a dealer; (d) allowing the player to choose a best player hand from the three player cards, the best player hand comprising either two or three of the player cards; (e) allowing the dealer to choose a best dealer hand from the three dealer cards, the best dealer hand comprising either two or three of the dealer cards; and (f) resolving the ante wager using the best player hand and the best dealer hand.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
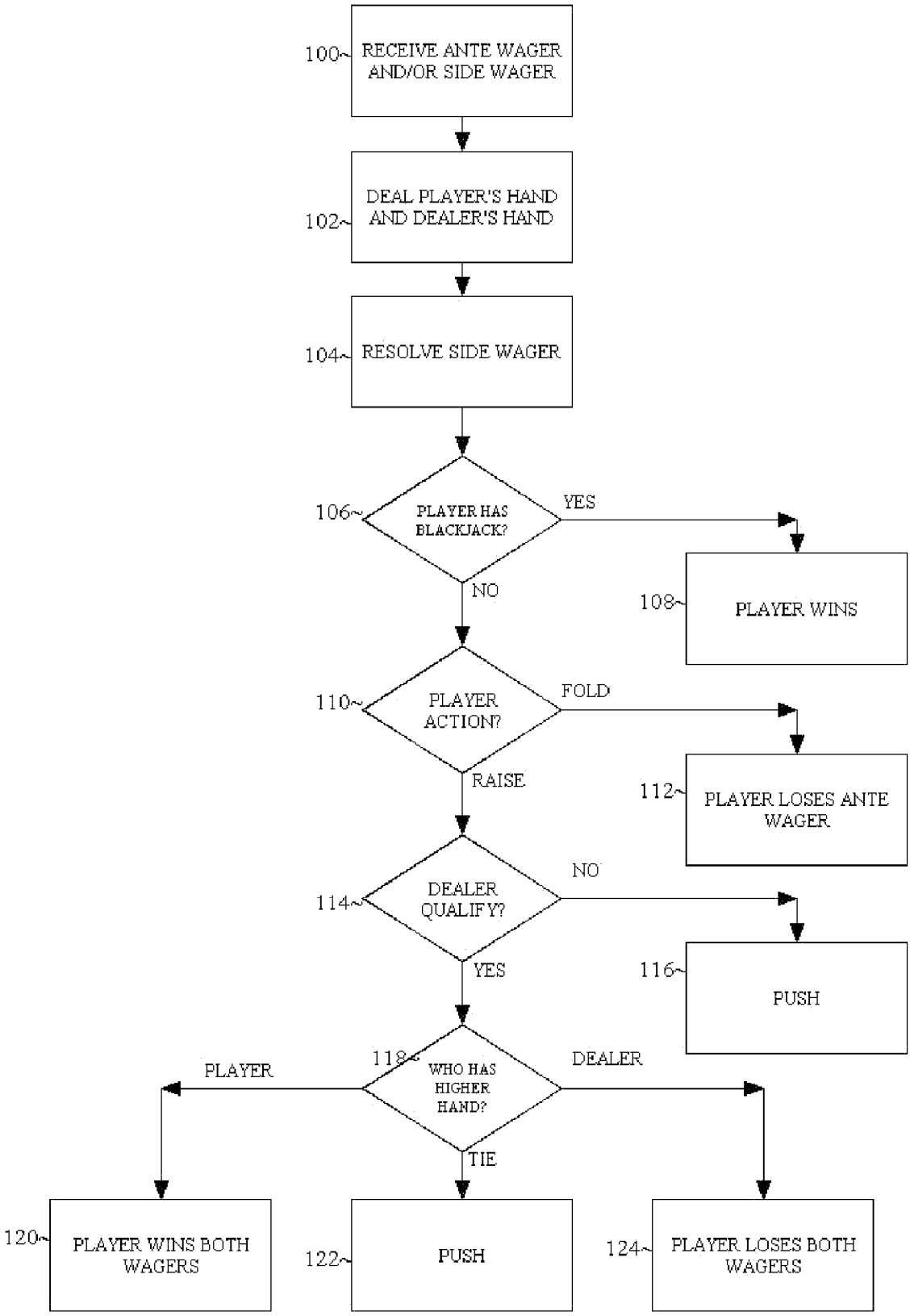
FIG. 1 is a flowchart illustrating an exemplary method of implementing a wagering game, according to an embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage which allows a casino to offer to player(s) a wager on a blackjack hand, typically with no draw. A player first places an ante wager and/or a side wager. Either wager may be optional or both may be required, according to an embodiment being implemented by the house. Both wagers may be required by the house to be equal amounts, or the house may let the player bet unequal amounts. The player is typically dealt three cards, and a dealer is dealt three cards.

The side wager (if placed) can easily be evaluated. The side wager is paid based upon the three player's cards. If the player's three cards contain one or more aces, the player wins a payout according to a paytable that is in being used. If the player has a blackjack, the player may receive an additional award.

Tables I-VI below are each sample paytables for the side wager. A represents an ace, X represented any card, and T represents a face value card (e.g. ten, jack, queen, king). The tables indicate each hand, how many ways to make that hand, the probability of attaining that hand, the award (EV) for that hand, and the contribution of that hand to the overall paytable (probability * EV). A casino may choose to implement any of these paytables. Thus, for example, using Table I, if the player bets $1 on the side bet, and is dealt an ace of spades, a ten of hearts, and a 3 of spades, this hand would be categorized as ("ATX") which pays $1 (plus the player keeps the original $1 so the player should typically have $2 in front of him/her). The player would be entitled to the highest award on the paytable that the player's hand would qualify for. The dealer can resolve (e.g. pay or take) the player's side wager immediately upon dealing the three player's cards, or at any time during the game (e.g. also at the end after the ante/play wagers are all resolved). If made, the side wager is paid regardless of whether the ante wager has been made by the player.

TABLE I

| Hand | Ways | prob (p) | EV | p*EV |
|---|---|---|---|---|
| Total hands | 22100 | | | |
| Nothing | 17296 | 0.782624 | −1 | −0.782624 |
| Axx | 1984 | 0.089774 | 1 | 0.089774 |
| ATx | 2048 | 0.092670 | 3 | 0.278009 |
| AU | 480 | 0.021719 | 6 | 0.130317 |
| AAx | 192 | 0.008688 | 15 | 0.130317 |
| AAT | 96 | 0.004344 | 25 | 0.108597 |
| AAA | 4 | 0.000181 | 100 | 0.018100 |
| | | | EDGE: | −2.75% |

TABLE II

| Hand | Ways | prob (p) | EV | p*EV |
|---|---|---|---|---|
| Total hands | 22100 | | | |
| Nothing | 17296 | 0.782624 | −1 | −0.782624 |
| Axx | 1984 | 0.089774 | 1 | 0.089774 |
| ATx | 2048 | 0.092670 | 3 | 0.278009 |
| ATT | 480 | 0.021719 | 6 | 0.130317 |
| AAx | 192 | 0.008688 | 12 | 0.104253 |
| AAT | 96 | 0.004344 | 30 | 0.130317 |
| AAA | 4 | 0.000181 | 100 | 0.018100 |
| | | | EDGE: | −3.19% |

TABLE III

| Hand | Ways | prob (p) | EV | p*EV |
|---|---|---|---|---|
| Total hands | 22100 | | | |
| Nothing | 17296 | 0.782624 | −1 | −0.782624 |
| Axx | 1984 | 0.089774 | 2 | 0.179548 |
| ATx | 2048 | 0.092670 | 3 | 0.278009 |
| ATT | 480 | 0.021719 | 5 | 0.108597 |
| AAx | 192 | 0.008688 | 10 | 0.086878 |
| AAT | 96 | 0.004344 | 20 | 0.086878 |
| AAA | 4 | 0.000181 | 100 | 0.018100 |
| | | | EDGE: | −2.46% |

TABLE IV

| Hand | Ways | prob (p) | EV | p*EV |
|---|---|---|---|---|
| Total hands | 22100 | | | |
| Nothing | 17296 | 0.782624 | −1 | −0.782624 |
| Axx | 1984 | 0.089774 | 1 | 0.089774 |
| ATx | 2048 | 0.092670 | 3 | 0.278009 |
| ATT | 480 | 0.021719 | 7 | 0.152036 |
| AAx | 192 | 0.008688 | 10 | 0.086878 |
| AAT | 96 | 0.004344 | 25 | 0.108597 |
| AAA | 4 | 0.000181 | 100 | 0.018100 |
| | | | EDGE: | −4.92% |

TABLE V

| Hand | Ways | prob (p) | EV | p*EV |
|---|---|---|---|---|
| Total hands | 22100 | | | |
| Nothing | 17296 | 0.782624 | −1 | −0.782624 |
| Axx | 1984 | 0.089774 | 1 | 0.089774 |
| ATx | 2048 | 0.092670 | 1 | 0.092670 |
| ATT | 480 | 0.021719 | 6 | 0.130317 |
| AAx | 192 | 0.008688 | 25 | 0.217195 |
| AAT | 96 | 0.004344 | 40 | 0.173756 |
| AAA | 4 | 0.000181 | 100 | 0.018100 |
| | | | EDGE: | −6.08% |

TABLE VI

| Hand | Ways | prob (p) | EV | p*EV |
|---|---|---|---|---|
| Total hands | 22100 | | | |
| Nothing | 17296 | 0.782624 | −1 | −0.782624 |
| Axx | 1984 | 0.089774 | 1 | 0.089774 |
| ATx | 2048 | 0.092670 | 3 | 0.278009 |
| ATT | 480 | 0.021719 | 6 | 0.130317 |
| AAx | 192 | 0.008688 | 10 | 0.086878 |
| AAT | 96 | 0.004344 | 25 | 0.108597 |
| AAA | 4 | 0.000181 | 100 | 0.018100 |
| | | | EDGE: | −7.10% |

The player may also place an optional ante wager (or the house may require it). After the player is dealt his/her three cards, the player can evaluate the player's three cards and choose the best blackjack hand. The dealer can also similarly evaluate his or her three dealer's cards and choose the best dealer's hand. Typically, both the player and the dealer would choose the hand (any two cards or three cards) out of their three cards which would form the best blackjack hand, that is the hand which totals or is the closest to totaling 21.

For example, consider that the player is dealt three cards, A, B, C. There are four possible blackjack hands that can be made from these three cards: A, B or A,C or B,C or A, B, C. The player should choose the two cards that would form the best hand (the hand with the total closest to 21, but not exceeding 21) out of these four possible blackjack hands. The method of evaluating hand totals is the same as that used in ordinary blackjack, where an ace can count as 1 or 11. As usual, hands of the form A,T (where T represents one of the face cards Ten, Jack, Queen, King) are referred to as "blackjacks." The dealer would similarly choose the best hand that the dealer can make out of the three cards. In an alternate embodiment, the player and dealer can only make three hands (AB, BC, AC, but the three card hand ABC would not be allowed). Thus, for the player and the dealer to set their hand properly, they will create all four hands, and take the one closest to 21 (but not over). If two or more hands tie each other, then it typically does not matter which hand the player or dealer picks and either can be picked at random (e.g. a ten spades/ten hearts/ten diamonds) two tens at random can be chosen since all three hands are of equal value (20)).

The game described herein can be played using a single standard deck of 52 cards without jokers. The cards can be dealt from an automatic shuffle machine that delivers packets of 3 cards each. Alternatively, the game can be hand dealt. A freshly shuffled deck can be used for the play of each hand. Alternatively, the game can be dealt from a shoe (as opposed to a shuffler machine). Alternatively, the game can be dealt from multiple decks (e.g. 2-6 or more) as opposed to a single deck. Alternatively, non-standard decks can be used (e.g. jokers, Spanish deck, or any known type of deck of cards).

FIG. 1 is a flowchart illustrating an exemplary method of implementing a wagering game, according to an embodiment.

The method can start with operation 100, which receives the ante wager and/or the side wager. According to house rules, both bets may be required, or the player may bet either one or the other.

The method can proceed to operation 102, which deals the player's hand (player's three cards) and the dealer's hand (dealer's three cards). The dealer's hand is typically dealt face down while the player's hand may be dealt face down or face up. If each player's hand is dealt face down, the respective player should be allowed to inspect his or her cards.

The method can proceed to operation 104, which resolves the side wager. The dealer can inspect each player's three cards and determine if each player has earned a payout or not. This operation can occur at any time during the method.

The method can proceed to operation 106, which determines if the player has blackjack. If the player has an ace and any ten valued card out of the player's three cards, then the player has blackjack. If the player has blackjack, the method proceeds to operation 108, wherein the player wins a 2:1 payout on the ante bet (or other payout such as 1:1 or 3:2 according to house rules). This round of the game ends for this player.

If the player does not have blackjack, then the method proceeds to operation 110, wherein the player takes his or her decided action (either play or fold). If the player, after reviewing his or her player's three cards, decides to fold (typically if the player believes he or she cannot beat the dealer), then the method proceeds to operation 112, wherein the player loses his or her ante wager. Note, a player who is also playing the side wager who wants to fold his or her ante will still be paid any side wager winnings he or she is due even if he or she folds his or her ante (this will only happen if the player folds AAA, AAx or Axx with a total of less than 19 if the player is playing properly. Optimal strategy will be discussed below in more detail.). This round of the game ends for this player.

If the player, in operation 110, decides to raise, then the player places a play (can also be called a 'raise') wager in the table. The play wager can be equal to the ante wager (or alternatively can be a multiple of it or can be less than or equal to the ante wager). If the player does raise then he competes against the dealer's hand. When the player raises the player also sets his or her hand, that is he indicates how he or she wishes to player the hand (e.g. which cards he or she wishes to use to make the best player hand). The player can take the cards forming his or her best hand and put them face down in a packet under the raise wager (or ante wager) optionally in a box in front of each player. Alternatively, the player can place the cards desired to make the best player hand (either two cards or all three) in a box on the table in front of the player.

The method can then proceed to operation 114, which determines whether the dealer qualifies. At this point in the game, the dealer's three cards can be revealed to the players at the table. The dealer needs a total between 17 and 21 for his best hand in order to "qualify." If the dealer does not have a hand out of the four possible hands totaling between 17 and 21, then the dealer does not qualify. If the dealer does not qualify, then the method proceeds to operation 116, wherein the player's ante wager pushes (neither wins nor loses). In this operation, the dealer can also reveal the player's cards and spread them face up to evaluate the hands (although the dealer should be careful to make sure he/she keeps the player's selected best hand intact).

If the determination in operation 114 determines that the dealer does qualify, then the method can proceed to operation 118, which determines who has the higher hand. Note that the dealer should always play properly, thus the dealer should never have a hand totaling more than 21. If the player incorrectly plays (set) his or her hand and has a total greater than 21, the player will lose (proceed to operation 124). Note that if the dealer has blackjack (and the player does not have blackjack), then the dealer automatically is considered to have the highest hand, and thus the method proceeds to operation 124. Thus for example, if the dealer is dealt: ten spades/ace diamonds, 6 clubs, and the player is dealt 7 diamonds/7 clubs/7 spades, the dealer has blackjack (since the dealer has an ace and a ten), thus the dealer wins even though the player's point total is also 21.

If the player has a higher hand than the dealer, then the method proceeds to operation 120, wherein the player wins both wagers (the ante wager and the play wager). This round of the game ends for this player.

If the player's hand total ties the dealer's hand total, then the method proceeds to operation 122, wherein the hand pushes, and both of the player's wagers (the ante wager and the play wager) push (neither win nor lose). This round of the game ends for this player.

If the dealer's hand is higher than the player's hand, then the method proceeds to operation 124, wherein the player loses both wagers (the ante wager and the play wager). This round of the game ends for this player.

Note that multiple players can play the game at the same time. Each player can be dealt their own separate hand, although the dealer typically has a same hand for all players.

Figure 2:
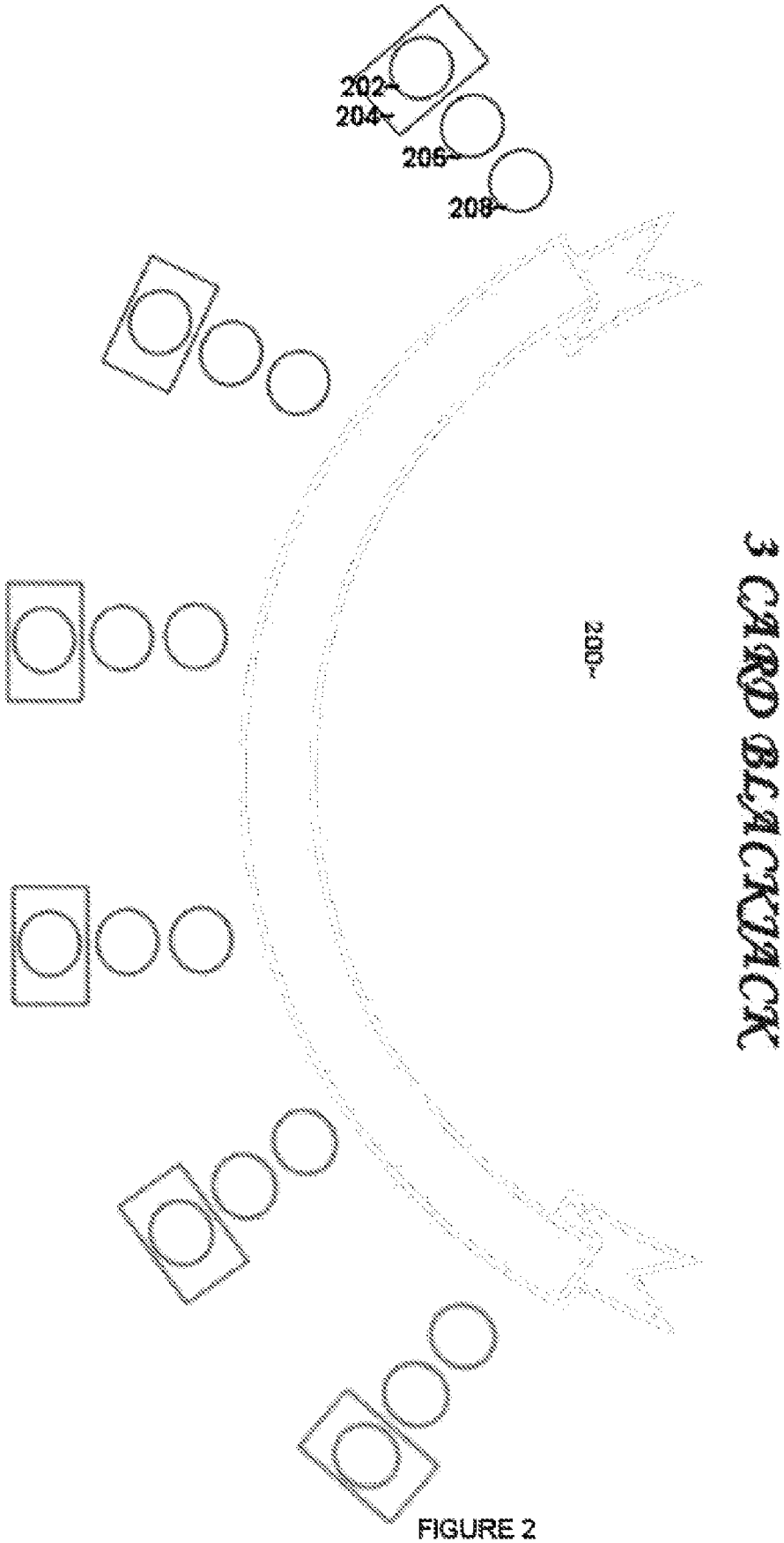
FIG. 2 is a table layout illustrating an exemplary table layout for implementing a wagering game, according to an embodiment.

FIG. 2 is a table layout illustrating an exemplary table layout for implementing a wagering game, according to an embodiment.

The table layout has spots for up to six players (or any other number). Each playing spot can have a play wager betting circle 202 (where the player can place his or her play wager), a play box 204 (where the player can place his or her best hand), an ante wager betting circle 206 (where the player can place his or her ante wager), and a side wager betting circle 208 (where the player can place his or her side wager). A dealer's hand area 200 is where the dealer can deal himself or herself the dealer's cards. Of course, other table layouts can be used as well, and this is merely one example. The circles can alternatively be placed in any order or orientation.

Table VII is a table illustrating possible outcomes of the game, their payouts, and the corresponding operation from FIG. 1.

TABLE VII

| | |
|---|---|
| Player does not play (112) | Player loses ante (regardless if the dealer qualifies or not). |
| Player has blackjack (108) | that is, two of his three cards are A and T (where T refers to one of the face cards Ten, Jack, Queen, or King). In this case the player wins 2-to-1 on his ante bet. He is not required to make a play wager and may immediately claim his blackjack, but if he does make a play wager, the play wager pushes, and the ante is paid 2-to-1. |
| Player plays and dealer does not qualify (116) | This hand is a push for both the play and ante bets. |
| Player plays and dealer has blackjack (124) | Player loses both ante and play wagers. |
| Player plays, dealer qualifies, and the dealer's best hand beats the player's best hand. (124) | Player loses both ante and play wagers. |
| Player plays, dealer qualifies, and the dealer's best hand loses to the player's best hand (120) | Player wins both ante and play wagers. |
| Player plays, dealer qualifies, and the dealer's best hand ties to player's best hand (122) | This hand is a push for both the play and ante bets. |

The optimal player strategy is to play any hand where the best hand has a total of 19 or more, and to fold all other hands. Using this strategy, the house edge for Three Card Blackjack is 4.256%. The player is of course not required to play by this strategy, and can play by whatever strategy the player wishes. A player who plays every hand where the best hand has a total of 18 or more, and folds all other hands, will give the house an edge of 5.284%.

Table VIII below illustrates the different outcomes of the game, the number of ways to make each outcome from a single deck of cards, the probability of each outcome occurring, the percentage chance of each outcome occurring, the payout for each outcome, and the probability & the payout for each outcome. Table VIII was made under the assumption that the player plays all hands of 19 and better and the dealer (house) qualifies with 17-21. Tables VII-VIII relate to the ante/play wagers but not the side wager which is not affected by the outcome of the ante/play wagers.

TABLE VIII

| EVENT | # of ways | Prob (p) | Percent | payoff (EV) | p*EV |
|---|---|---|---|---|---|
| Player does not play and dealer does not qualify | 23297520 | 0.05721811 | 5.7218% | −1 | −0.05721811 |
| Player does not play and dealer qualifies | 129695376 | 0.31852850 | 31.8528% | −1 | −0.31852850 |
| PLAYER PLAYS HAND IN ALL OF THE FOLLOWING | | | | | |
| Dealer does not qualify, player has blackjack (all blackjacks win) | 8533216 | 0.02095736 | 2.0957% | 2 | 0.04191472 |
| Dealer does not qualify, player plays, does not have blackjack | 34643056 | 0.08508245 | 8.5082% | 0 | 0.00000000 |
| DEALER QUALIFIES (PLAYS HAND IN ALL OF THE FOLLOWING) | | | | | |
| Player has blackjack (all blackjacks win 2-1 on Ante bet) | 39811360 | 0.09777567 | 9.7776% | 2 | 0.19555135 |
| Dealer has blackjack, player plays, does not have blackjack | 24594336 | 0.06040305 | 6.0403% | −2 | −0.12080611 |
| Player's best blackjack hand loses to dealer's best blackjack hand | 30057040 | 0.07381931 | 7.3819% | −2 | −0.14763863 |
| Player's best blackjack hand beats dealer's best blackjack hand | 74138064 | 0.18208117 | 18.2081% | 2 | 0.36416235 |
| Player's best blackjack hand pushes dealer's best blackjack hand | 42400432 | 0.10413437 | 10.4134% | 0 | 0.00000000 |
| TOTAL: | 407170400 | | | EDGE: | −4.256294% |

An example game will now be presented to illustrate one possible operation of the game using two players (although of course any number of players can be used). Player 1 bets $1 on the side wager and $2 on the ante wager (operation 100). Player 2 bets $3 on the side wager and $3 on the ante wager (operation 100). A dealer is dealt three dealer cards (face down) (operation 102). Player one is dealt ace diamonds/three clubs/three spades (either face up or face down, but if face down player one is allowed to inspect his or her cards) (operation 102). Player two is dealt ten clubs/ten spades/5 hearts (either face up or face down, but if face down player two is allowed to inspect his or her cards) (operation 102). Player one is paid $1 on the side wager (from table I) (operation 104). Player two loses her side wager (operation 104). The dealer may inspect these cards to resolve the wagers now or at a later time.

Player one, after inspecting his cards, decides to fold (operation 110) and thus loses his $2 ante wager (operation 112). The game is over now for player one. Player two, after inspecting her cards, decides to play/raise (operation 110) and places a $3 play wager on the table (operation 110), and chooses the ten of clubs/ten of spades as her hand (operation 110) by putting these cards in a box on front of her (face up or face down), or any other way to indicate to the dealer that she wishes to select these two cards as her hand. Another way the player can indicate her best hand is by putting the ten clubs/ten of spades together face down and under the play wager. Ultimately, the dealer must be able to see the players' cards to resolve the wagers. The dealer now reveals his cards (can be revealed, for example, at operation 114), and exposes a seven clubs/three hearts/two spades. Out of all of the four possible hands the dealer can make, the best hand would be using all three cards for a total of 12, which would not qualify since the dealer needs at least a 17 to qualify. Thus, the dealer doesn't qualify and player two pushes on the ante and play wagers. The game is over now for player two.

A second example of how the game can be played will now be presented. Player 1 bets $1 on the side wager and $2 on the ante wager (operation 100). Player 2 bets $3 on the side wager and $3 on the ante wager (operation 100). A dealer is dealt three dealer cards (face down) (operation 102). Player one is dealt three clubs/eight clubs/ten spades (either face up or face down, but if face down player one is allowed to inspect his or her cards) (operation 102). Player two is dealt ten clubs/seven spades/seven hearts (either face up or face down, but if face down player two is allowed to inspect his or her cards) (operation 102). Player one loses his side wager (from table I) (operation 104). Player two loses her side wager (operation 104).

Player one, after inspecting his cards, decides to play/raise (operation 110) and places a $2 play wager on the table (operation 110). Player one indicates that he wishes to use all three cards by placing all three cards in the box in front of him (operation 110) (either face up or face down), or alternatively putting the cards together and under the play wager (either face up or face down). Player two, after inspecting his cards, decides to play/raise (operation 110) and places a $3 play wager on the table (operation 110). Player two chooses as his best hand the ten clubs and the seven spades (operation 110). Note that the correct play, according to optimal strategy, would be to fold. But of course, each player can play as they please. The dealer reveals his cards and reveals an eight clubs, ten hearts, seven spades (operation 114). The best dealer's hand would be to use the ten hearts and the eight clubs for a total of 18. Since the dealer's total is greater than 17, the dealer qualifies (operation 114). Thus the dealer resolves the ante/play wagers now. Player one has a total of 21. Player ones best hand totals 21 and beats the dealer's best hand of 18. Thus, the player one wins his ante wager and play wager and thus wins $2 for his ante wager and $2 for his play wager (wins $4 in total) (operation 120). Player two's best hand totals 17, which does not beat the dealer's total of 18. Thus player two loses his $3 ante wager and $3 play wager ($6 in total) (operation 124). Of course how each player chooses their best hand is up to the players, although the dealer should typically always choose the mathematically best hand out of the four possible hands. It is also noted that the identification of operations in the above examples is just exemplary, and the actions described herein can be taken in other orders or part o f other operations as well. Actions can be taken in any sequence or combined with any other operation that is sensible. It is also noted that some operations in FIG. 1 combine both decisions blocks and actions for simplicity, but these could also have been illustrated as separate blocks as well.

It is noted that the operations described above can be performed in numerous orders. For example, the side wager can be resolved at any point in the game when all of the cards that are needed in the poker hand are revealed. Thus, the side wager can be resolved after the blackjack hand is resolved, or just before it is resolved, or at any other point.

In a further embodiment, a game as described herein can be played on an electronic device, such as an electronic gaming machine (EGM). The game can also be played over a computer communications network, such as the Internet, played on computers, and can also be offered at online casinos.

Figure 3:
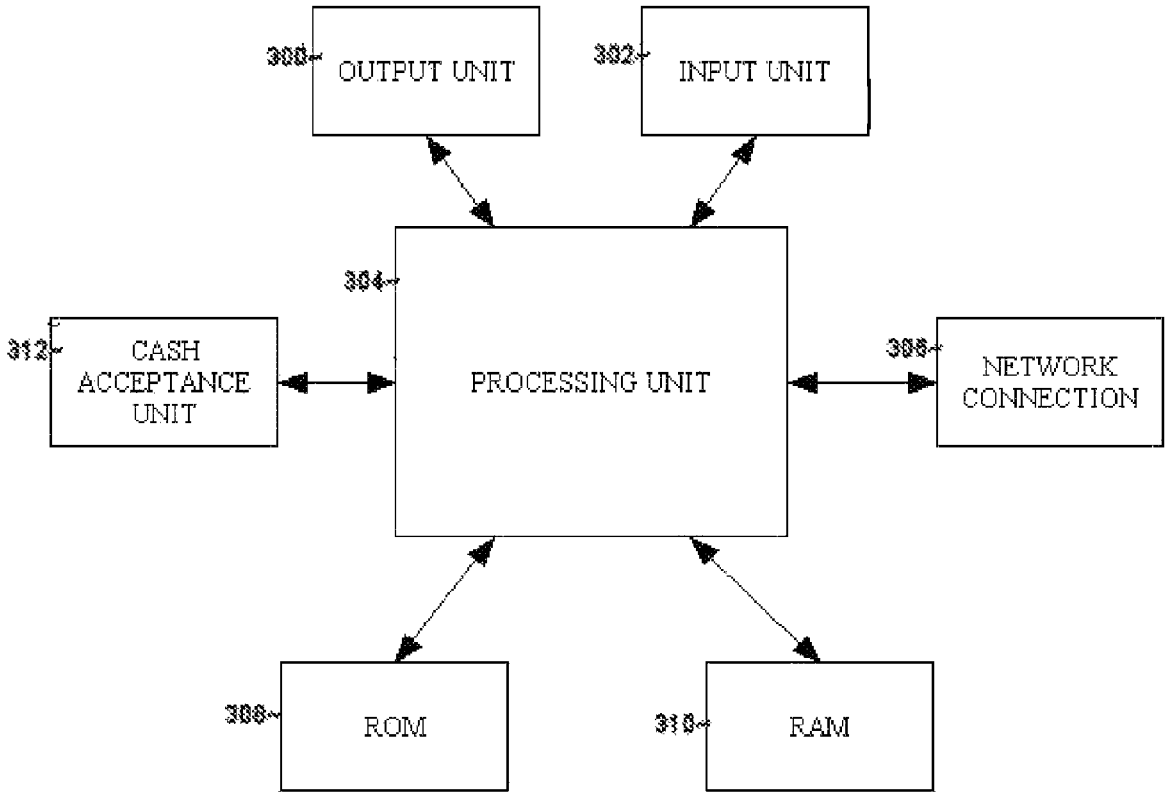
FIG. 3 is an exemplary block diagram of hardware that can be used to implement an electronic embodiment.

FIG. 3 is an exemplary block diagram of hardware that can be used to implement an electronic embodiment.

A processing unit 304 can be connected to an output unit 300 (e.g. a CRT, LCD, etc.), an input unit 302 (e.g. a touch screen, keyboard, buttons, etc.), a network connection 306 (e.g. connection to a casino server or the Internet or other communication network), a ROM 308, a RAM 310, and a cash acceptance unit 312 (which can accept cash or other methods of payment to place wagers).

Any embodiments described herein can be played with a standard deck of cards or any type of special deck (e.g. a Spanish deck, etc.) The game can also be played with a single deck or multiple decks (e.g. 1-8 decks or more). Standard rules of blackjack can be used as well as any known variation of blackjack. Further, the order of any of the operations described herein can be performed in any order and wagers can be placed/resolved in any order. Any embodiments herein can also be played in electronic form and programs and/or data for such can be stored on any type of computer readable storage medium (e.g. CD-ROM, DVD, disk, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a wagering game between a player and a dealer for a casino, the method comprising:

providing a physical deck(s) of cards;

receiving an ante wager from a player;

dealing, from the physical deck(s), three player cards to the player;

dealing, from the physical deck(s), three dealer cards to a dealer;

allowing the player to choose a best player blackjack hand from the three player cards, the best player hand comprising, at the player's choice, a range of two to three of the player cards;

allowing the dealer to choose a best dealer blackjack hand from the three dealer cards, the best dealer hand comprising, at the dealer's choice, a range of two to three of the dealer cards;

allowing the player to raise, wherein the player places a raise wager and continues playing, or allowing the player to fold, wherein the player loses the ante wager and the game ends;

determining if the best dealer blackjack hand meets a qualifying characteristic, and if the best dealer blackjack hand does not meet the qualifying characteristic, then the game ends; and if the best dealer blackjack hand does meet the qualifying characteristic, then: if the best player blackjack hand using blackjack rules is higher than the best dealer blackjack hand using blackjack rules then the player wins both the ante wager and the raise wager, and if the best player hand using blackjack rules is lower than the best dealer hand using blackjack rules then the player loses both the ante wager and the raise wager.

2. The method as recited in claim 1, wherein If the best player hand ties the best dealer hand then the player does not win or lose both the ante wager and the raise wager.

3. The method as recited in claim 1, further comprising: receiving a side wager from the player before the player has seen the three player cards; and once the player has seen the three player cards, paying the player a payout on the side wager based on a combination formed from the three player cards using a paytable.

4. The method as recited in claim 3, wherein if one of the three player cards is an ace, then the player wins a payout on the side wager.

* * * * *